US011160333B2

(12) United States Patent
Yu

(10) Patent No.: US 11,160,333 B2
(45) Date of Patent: Nov. 2, 2021

(54) EYELETS

(71) Applicant: Chung Han Yu, Yongin-si (KR)

(72) Inventor: Chung Han Yu, Yongin-si (KR)

( * ) Notice: Subject to any disclaimer, the term of this patent is extended or adjusted under 35 U.S.C. 154(b) by 329 days.

(21) Appl. No.: 16/458,206

(22) Filed: Jul. 1, 2019

(65) Prior Publication Data

US 2020/0008540 A1 Jan. 9, 2020

(30) Foreign Application Priority Data

Jul. 5, 2018 (KR) ..... 10-2018-0078073

(51) Int. Cl.
*A44B 13/00* (2006.01)

(52) U.S. Cl.
CPC ..... *A44B 13/0076* (2013.01); *A44B 13/0058* (2013.01); *A44B 13/0064* (2013.01)

(58) Field of Classification Search
CPC ..... A44B 13/0076; A44B 13/0058; A44B 13/0064; A44B 13/007; A44B 13/008; A44B 13/0094; B60R 16/0222; B60R 16/0215; F16B 5/0258
USPC ..... 16/2.1, 2.2, 2.5; 24/713.6, 713.7
See application file for complete search history.

(56) References Cited

U.S. PATENT DOCUMENTS 1,031,024 A * 7/1912 Pickles ..... A43C 5/00 24/713.7
3,512,224 A * 5/1970 Newton ..... A44B 13/0082 411/447
4,372,013 A * 2/1983 Gautier, Jr. ..... A43C 5/00 16/2.1
5,069,586 A * 12/1991 Casey ..... A44B 13/007 411/339
6,006,406 A * 12/1999 Chung ..... A41H 37/02 24/114.12
6,953,064 B2 * 10/2005 Golz ..... A44B 13/0076 139/383 R
9,003,618 B2 * 4/2015 Violato ..... A41F 1/02 24/713.7
9,273,707 B2 * 3/2016 Lee ..... A44B 13/0076
10,214,162 B2 * 2/2019 Kamenoue ..... B60R 16/0222
10,351,082 B2 * 7/2019 Kim ..... A44B 13/0088
10,357,084 B2 * 7/2019 Yu ..... C08L 23/06
10,499,708 B2 * 12/2019 You ..... A45C 13/1076
10,626,943 B2 * 4/2020 Namiki ..... F16F 1/3732
2009/0126148 A1 * 5/2009 Tripont ..... A47H 13/02 16/2.1
2010/0043171 A1 * 2/2010 Kwon ..... A44B 13/007 16/2.1

(Continued)

*Primary Examiner* — Jeffrey O'Brien
(74) *Attorney, Agent, or Firm* — Revolution IP, PLLC

(57) ABSTRACT

The present disclosure relates to an eyelet which is easily fastened and has a strong coupling force, and the eyelet of the present disclosure includes an eyelet base and an eyelet washer, wherein the eyelet base includes: a disk-shaped base part having a circular hollow hole formed at a center portion thereof; a cylindrical fastening part formed to extend from an inner circumference of the base part formed by the hollow hole to be orthogonal to the base part, and inserted into a circular hollow hole in a center portion of the eyelet washer to be fastened to the eyelet washer; and a fixing protrusion formed in a ring shape on an outer circumference of the fastening part to prevent separation of the eyelet washer from the fastening part.

9 Claims, 6 Drawing Sheets

(56) References Cited

U.S. PATENT DOCUMENTS

2014/0033474 A1* 2/2014 Violato ..... A44B 13/0082
16/2.1

* cited by examiner

EYELETS

CROSS-REFERENCE TO RELATED APPLICATION

This application claims priority to and the benefit of Korean Patent Application No. 2018-0078073, filed on Jul. 5, 2018, the disclosure of which is incorporated herein by reference in its entirety.

BACKGROUND

1. Field of the Invention

The present disclosure relates to an eyelet, and more particularly, to an eyelet which is easily fastened and capable of providing a coupling force.

2. Discussion of Related Art

Generally, an eyelet is coupled to a document, vinyl, a fabric, or the like through a hole formed in the document, the vinyl, the fabric, or the like, and is used to connect or fix the above to another structure. Particularly, the eyelet is widely used with a fabric such as a tarpaulin. The tarpaulin is a waterproof fabric which is sturdy while being as light and flexible as vinyl, and the tarpaulin is made by crossing yarns formed of low density polyethylene (LDPE) and high density polyethylene (HDPE) as warp and weft yarns to form a fabric, and coating polyethylene (PE) which is the same material on upper and lower surfaces of the fabric.

The tarpaulin can be used for a variety of purposes, such as a shade cover, a tarp, a groundsheet, a cover of a truck, or the like. In this case, the tarpaulin is fixed by forming a hole in an edge portion of the tarpaulin and using a rope bound to the hole, and the edge portion of the tarpaulin can be easily damaged by the rope. In order to prevent damage, since an eyelet is coupled to the hole according to a circumference of the hole and comes into contact with the rope, the damage to the tarpaulin can be prevented.

However, a conventional eyelet is manufactured of a general plastic or metal, and since the eyelet formed of the general plastic or metal cannot be recycled with other materials constituting a tarpaulin, the eyelet should be separated from the tarpaulin to recycle the tarpaulin.

Further, in the conventional case, the eyelet is heated and pressed to be coupled to the tarpaulin, and in this case, the tarpaulin can be damaged by heat applied to the eyelet. Further, the eyelet is deformed by the heat and thus there is a problem that a coupling force between the tarpaulin and the eyelet is weakened.

SUMMARY OF THE INVENTION

The present disclosure is directed to providing an eyelet which can be coupled to a fabric without using heat.

Further, the present disclosure is directed to providing an eyelet capable of strengthening a coupling force between a fabric and the eyelet.

In addition, the present disclosure is directed to providing an eyelet recyclable with a tarpaulin.

Technical problems desired to be solved by the present disclosure are not limited to the above-described problems, and problems which are not mentioned may be clearly understood by those skilled in the art from the following disclosure.

According to an aspect of the present disclosure, there is provided an eyelet including an eyelet base and an eyelet washer, wherein the eyelet base includes: a disk-shaped base part having a circular hollow hole formed at a center portion thereof; a cylindrical fastening part formed to extend from an inner circumference of the base part formed by the hollow hole to be orthogonal to the base part, and inserted into a circular hollow hole in a center portion of the eyelet washer to be fastened to the eyelet washer; a fixing protrusion formed in a ring shape on an outer circumference of the fastening part to prevent separation of the eyelet washer from the fastening part; and a plurality of stoppers configured to protrude from a lower surface of the base part to prevent rotation of the eyelet washer fastened to the eyelet base, the eyelet washer includes: a plurality of protrusions formed on an upper surface of the eyelet washer facing the base part and whose movement is limited by the stoppers to prevent the rotation of the eyelet washer; and a protection protrusion formed in a ring shape to protrude from a lower surface of the eyelet washer, and the protection protrusion is configured to fix and protect a lower end of the fastening part inserted between the fixing protrusion and the protection protrusion due to plastic deformation when the eyelet base and the eyelet washer are fastened to each other.

A diameter of the fixing protrusion may be greater than a diameter of the circular hollow hole of the eyelet washer, and the fixing protrusion may protrude so as to have a step at the outer circumference of the fastening part. An upper portion of the fixing protrusion may include a flat surface vertical to the outer circumference of the fastening part, and a lower portion of the fixing protrusion may include an inclined surface connected to the flat surface.

Further, the eyelet base may further include a curved portion having a curvature at a portion in which the base part and the fastening part come into contact with each other.

The eyelet washer may be fastened to the eyelet base between the base part and the fixing protrusion, and an inner circumference of the eyelet washer may have an inclined surface so that an upper portion thereof may have a diameter greater than a diameter of a lower portion thereof.

According to another aspect of the present disclosure, there is provided an eyelet including an eyelet base and an eyelet washer, wherein the eyelet base includes: a disk-shaped base part having a circular hollow hole formed at a center portion thereof; a cylindrical fastening part formed to extend from an inner circumference of the base part formed by the hollow hole to be orthogonal to the base part, and inserted into a circular hollow hole in a center portion of the eyelet washer to be fastened to the eyelet washer; a fixing protrusion formed in a ring shape on an outer circumference of the fastening part to prevent separation of the eyelet washer from the fastening part; and a plurality of stoppers configured to protrude from a lower surface of the base part to prevent rotation of the eyelet washer fastened to the eyelet base, the eyelet washer includes: a plurality of grooves formed in shapes corresponding to the stoppers in an upper portion of the eyelet washer facing the base part and configured to accommodate the stoppers in a one-to-one manner to prevent the rotation of the eyelet washer; and a protection protrusion formed in a ring shape to protrude from a lower surface of the eyelet washer, and the protection protrusion is configured to fix and protect a lower end of the fastening part inserted between the fixing protrusion and the protection protrusion due to plastic deformation when the eyelet base and the eyelet washer are fastened to each other.

BRIEF DESCRIPTION OF THE DRAWINGS

The above and other objects, features and advantages of the present disclosure will become more apparent to those of ordinary skill in the art by describing in detail exemplary embodiments thereof with reference to the accompanying drawings, in which.

DETAILED DESCRIPTION OF EXEMPLARY EMBODIMENTS

The above-described purposes, characteristics, and advantages will be more apparent through the following detailed descriptions with reference to the accompanying drawings, and accordingly, those skilled in the art may easily carry out the technical spirit of the present disclosure. Further, in a description of the present disclosure, when specific descriptions such as related technologies related to the present disclosure unnecessarily obscure the spirit of the present disclosure, a detailed description of the specific descriptions will be omitted.

Hereinafter, an eyelet according to an embodiment of the present disclosure will be described in detail with reference to the accompanying drawings.

First Embodiment

Figure 1:
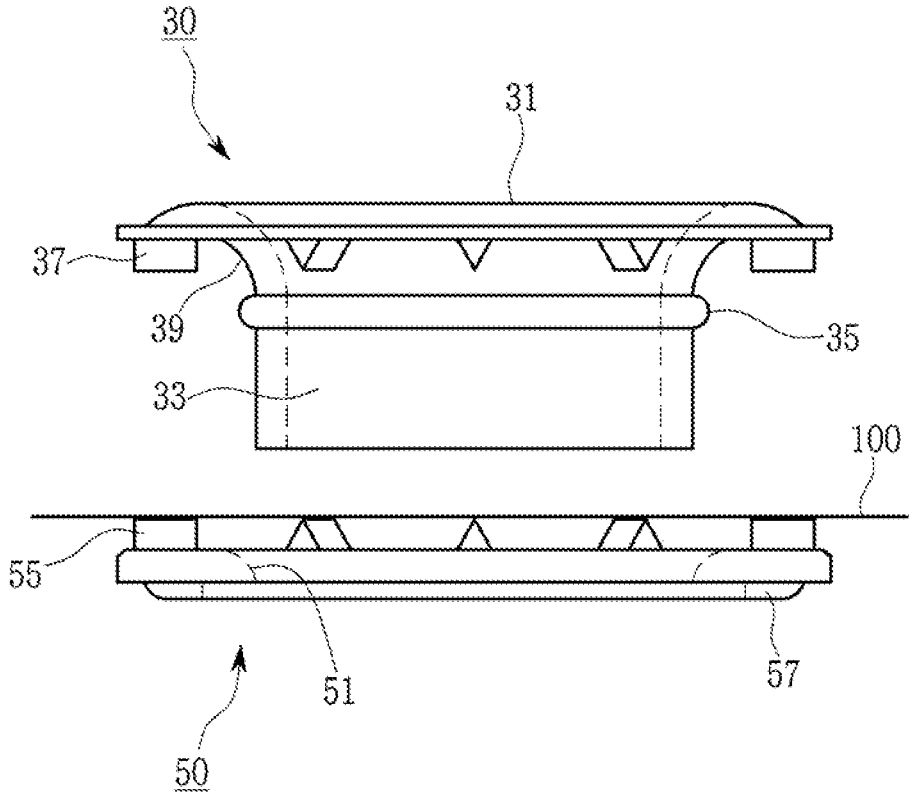
FIG. 1 is a front view illustrating an eyelet according to a first embodiment of the present disclosure.
Figure 2:
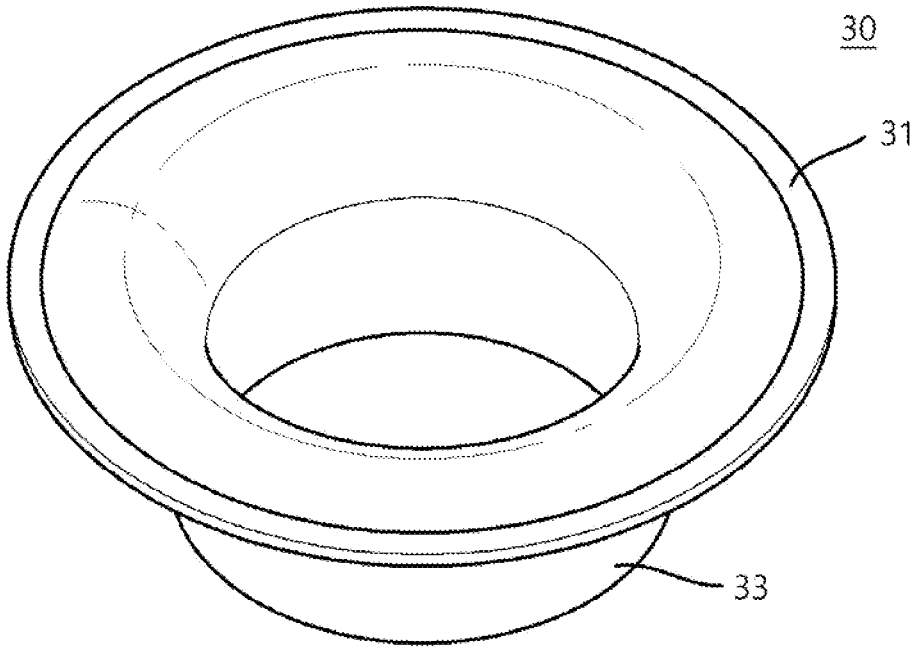
FIG. 2 is a perspective view illustrating an eyelet base 30 of FIG. 1.
Figure 3:
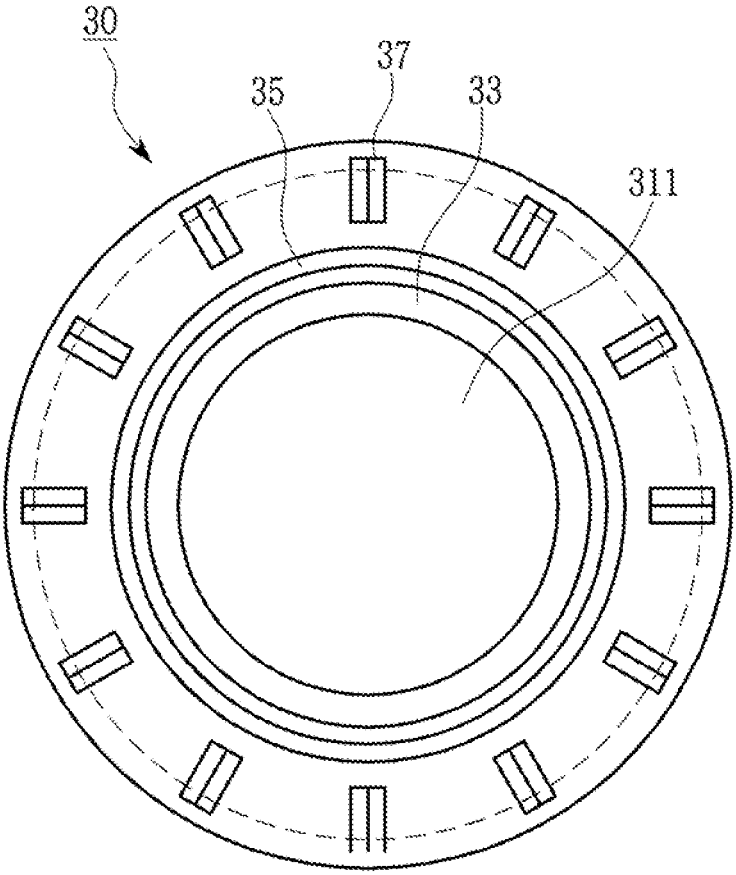
FIG. 3 is a plan view illustrating a lower surface of the eyelet base 30 of FIG. 1.
Figure 4:
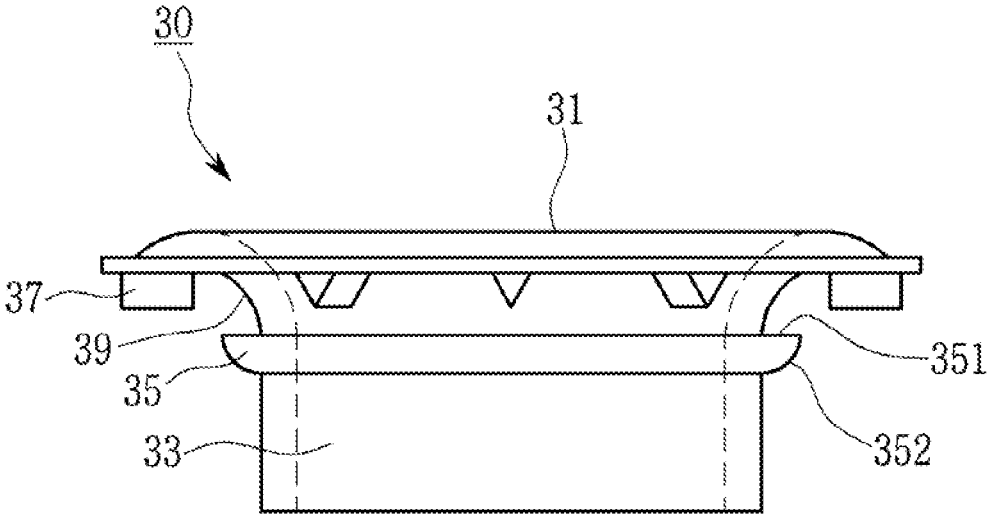
FIG. 4 is a view illustrating another example of the eyelet base 30 according to the present disclosure.
Figure 5:
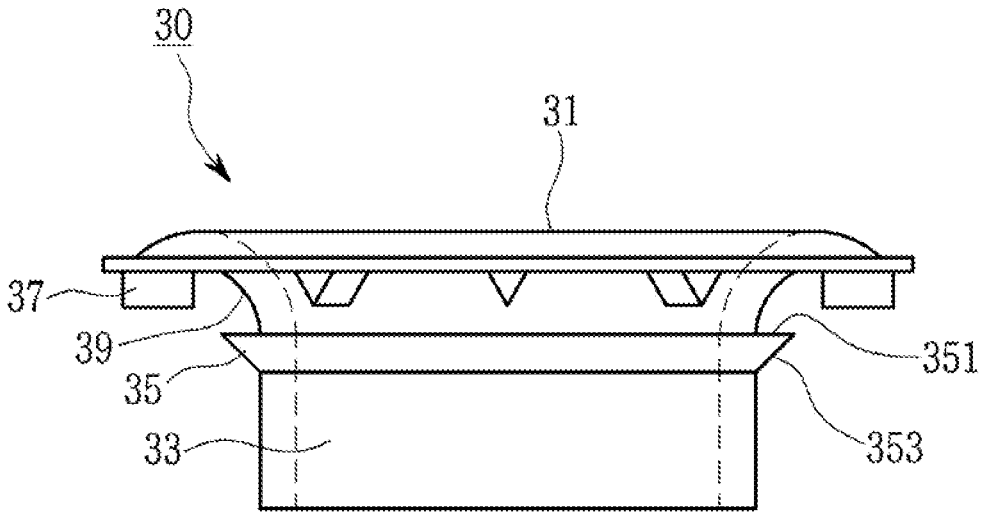
FIG. 5 is a view illustrating still another example of the eyelet base 30 according to the present disclosure.

FIG. 1 is a front view illustrating an eyelet according to a first embodiment of the present disclosure, and FIG. 2 and FIG. 3 are views illustrating an eyelet base 30 of FIG. 1. FIG. 4 is a view illustrating another example of the eyelet base 30 according to the present disclosure, and FIG. 5 is a view illustrating still another example of the eyelet base 30 according to the present disclosure.

As shown in FIG. 1, the eyelet according to the first embodiment of the present disclosure includes an eyelet base 30 and an eyelet washer 50 coupled to each other with a fabric 100 such as a tarpaulin or the like therebetween. The eyelet base 30 and the eyelet washer 50 may be formed of a material recyclable with the tarpaulin, for example, a thermoplastic olefin-based resin, and the olefin-based resin may include one of polyethylene (PE) and polypropylene (PP). Here, when the eyelet includes the polyethylene (PE), it is preferable to use a mixture of low density polyethylene (LDPE) and high density polyethylene (HDPE). As described above, when the eyelet of the present disclosure includes a material recyclable with the tarpaulin, since the eyelet is recyclable with the tarpaulin without being separated from the tarpaulin, recycling is easy. Further, since the olefin-based resin has greater elasticity and is resistant against abrasion or deformation in comparison with general plastic or metal, the stability of the eyelet may be secured.

As shown in FIGS. 1 to 3, the eyelet base 30 includes a base part 31, a fastening part 33, a fixing protrusion 35, a plurality of stoppers 37, and a curved portion 39.

The base part 31 is configured in a disk shape having a circular hollow hole 311 formed at a center portion thereof.

The fastening part 33 is formed in a cylindrical shape, and an upper portion of the fastening part 33 is formed to extend from an inner circumference of the base part 31 formed by the hollow hole 311 to be orthogonal to the base part 31. Further, the fastening part 33 is inserted into a circular hollow hole 53 in a center portion of the eyelet washer 50 to be fastened to the eyelet washer 50.

The fixing protrusion 35 is formed in a ring shape on an outer circumference of the fastening part 33 to prevent separation/breakaway of the eyelet washer 50 from the fastening part 33. A diameter of the fixing protrusion 35, that is, a distance from a center of the hollow hole 311 to an outer circumference of the fixing protrusion 35 may be greater than a diameter of the circular hollow hole 53 of the eyelet washer 50. Further, the fixing protrusion 35 may have a protruding shape to have a step at the outer circumference of the fastening part 33. A cross-section of the fixing protrusion 35 shown in FIG. 1 has a semi-circle shape but may be configured in other shapes. For example, as shown in FIG. 4, an upper portion of the fixing protrusion 35 may have a flat surface 351 vertical to the outer circumference of the fastening part 33 and a lower portion of the fixing protrusion 35 may have a curved surface 352 connected to the flat surface 351. Further, as shown in FIG. 5, the upper portion of the fixing protrusion 35 has the flat surface 351 vertical to the outer circumference of the fastening part 33, and the lower portion of the fixing protrusion 35 may have an inclined surface 353 connected to the flat surface 351.

The stoppers 37 are formed on a lower surface of the base part 31 to prevent rotation of the eyelet washer 50 fastened to the eyelet base 30, and are formed in a shape protruding from the lower surface of the base part 31. The stoppers 37 are radially arranged at predetermined intervals, a longitudinal direction of each of the stoppers 37 faces the center of the hollow hole 311, and a cross-section of the stopper 37 has a triangular shape. The stopper 37 may be formed in other shapes.

The curved portion 39 is formed to have a curvature at a portion in which the base part 31 and the fastening part 33 come into contact with each other.

Figure 6:
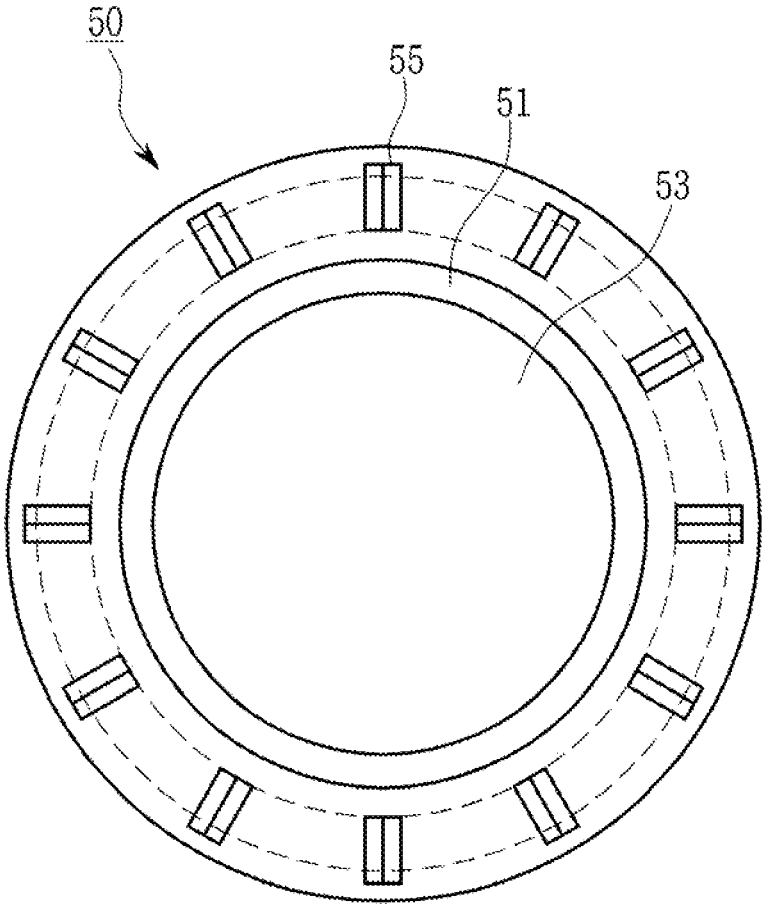
FIG. 6 is a plan view illustrating an upper surface of an eyelet washer 50 of FIG. 1.
Figure 7:
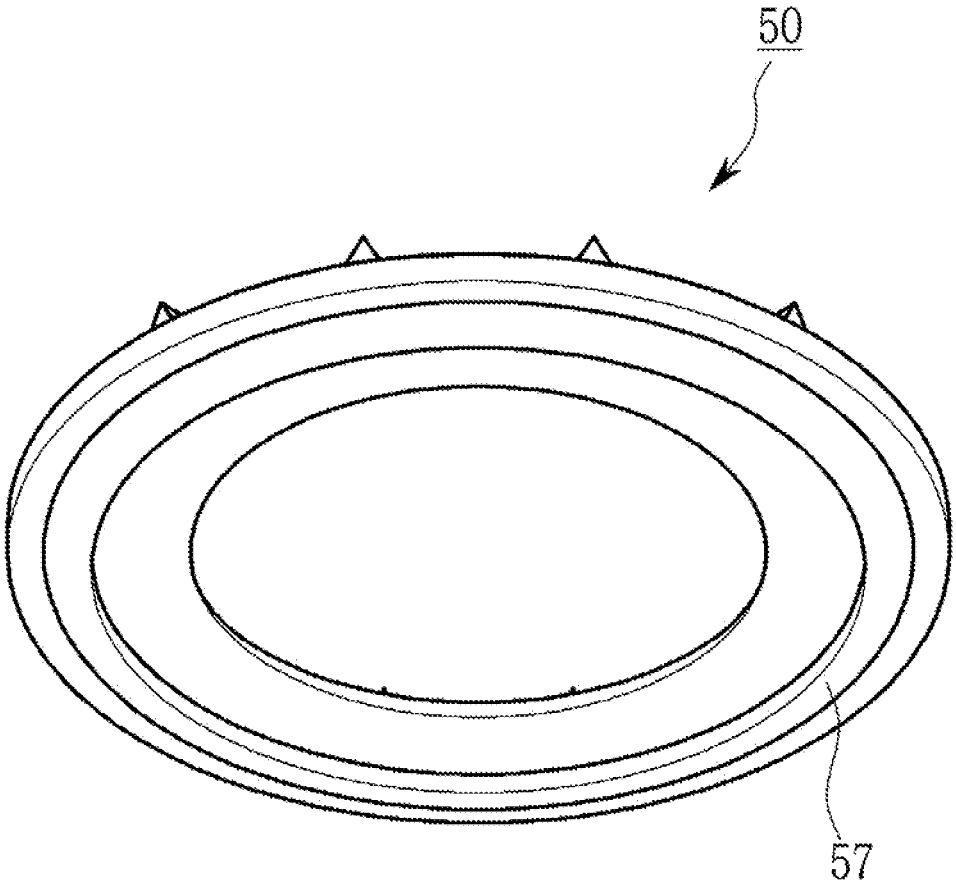
FIG. 7 is a perspective view illustrating a lower surface of the eyelet washer 50.

FIG. 6 is a view illustrating an upper surface of the eyelet washer 50 of FIG. 1, and FIG. 7 is a perspective view illustrating a lower surface of the eyelet washer 50.

As shown in FIG. 6, the eyelet washer 50 includes a plurality of protrusions 55 formed on an upper surface thereof facing the base part 31. The protrusions 55 are radially arranged at predetermined intervals on the upper surface of the eyelet washer 50. When the eyelet base 30 and the eyelet washer 50 are fastened to each other, the protrusions 55 have their movement limited by the stoppers 37. That is, the stoppers 37 and the protrusions 55 come into contact with each other to limit the rotation of the eyelet washer 50. Further, since the stoppers 37 press the upper surface of the eyelet washer 50 and the protrusions 55 press the lower surface of the base part 31, the rotation of the eyelet washer 50 is limited by this pressing force.

The eyelet washer 50 is fastened to the eyelet base 30 between the base part 31 and the fixing protrusion 35, and an inner circumference 51 of the eyelet washer 50 has an inclined surface or a curved surface so that the eyelet washer 50 may easily move over the fixing protrusion 35 when the eyelet washer 50 is fastened to the eyelet base 30. The inclined surface or the curved surface is formed so that an upper diameter of the inner circumference 51 is formed to be greater than a lower diameter of the inner circumference 51.

As shown in FIG. 7, the eyelet washer 50 includes a protection protrusion 57 formed in a ring shape to protrude from the lower surface thereof, and the protection protrusion 57 is used to fix and protect a lower end of the fastening part 33 which is plastically deformed.

Figure 8:
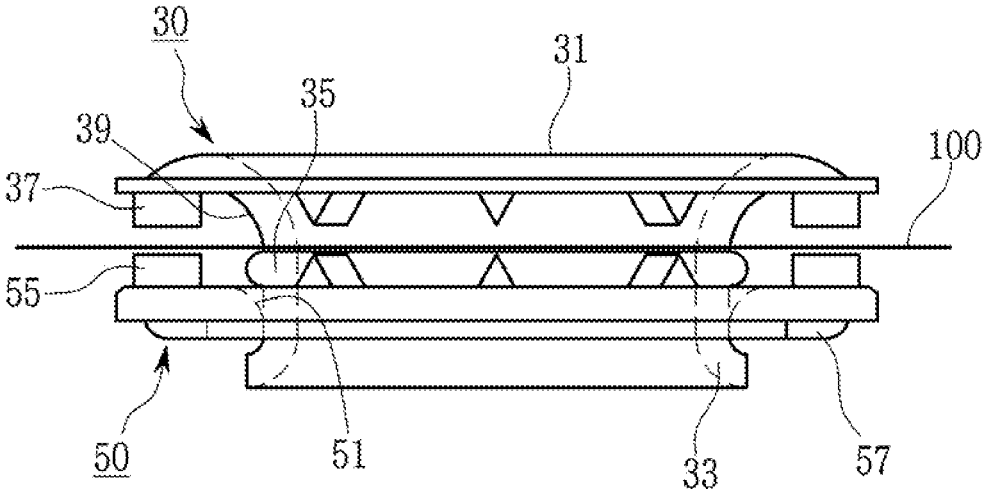
FIGS. 8 and 9 are views for describing a method of fastening the eyelet base 30 and the eyelet washer 50.
Figure 9:
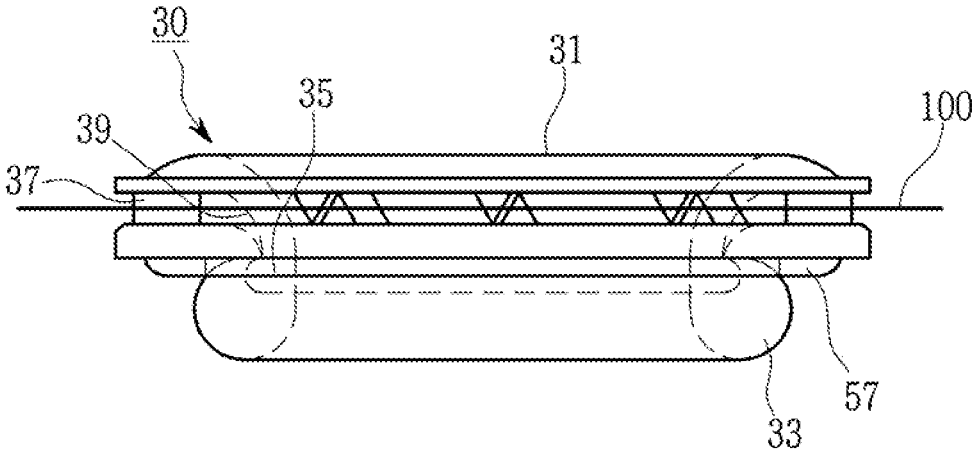

Hereinafter, a method of fastening the eyelet base 30 and the eyelet washer 50 will be described. FIGS. 8 and 9 are views for describing the method of fastening the eyelet base 30 and the eyelet washer 50.

As shown in FIG. 8, when the eyelet base 30 and the eyelet washer 50 are pressed in a state in which the fastening part 33 is inserted into the hollow hole 53 of the eyelet washer 50 through a hole of the fabric 100, a lower portion of the fastening part 33 is elastically deformed and thus the lower portion of the fastening part 33 is wrapped to the outside and rolled up in a circular shape. In this case, the lower portion of the fastening part 33 is elastically deformed by a physical force without using heat or ultrasonic waves, and the above is caused by a material characteristic of the eyelet according to the present disclosure.

When pressing continues, as shown in FIG. 9, the eyelet washer 50 moves to a space between the base part 31 and the fixing protrusion 35 through the fixing protrusion 35, and an end of the lower portion of the fastening part 33 reaches a space between the fixing protrusion 35 and the protection protrusion 57 after the lower portion of the fastening part 33 is rolled up in the circular shape. The protection protrusion 57 protects and fixes the wrapped lower portion of the fastening part 33, particularly, the end of the lower portion of the fastening part 33 so as not to be released by external pressure or friction.

The fastened eyelet base 30 and eyelet washer 50 are fixed by the lower portion of the fastening part 33 which is plastically deformed and the fixing protrusion 35, and as described above, a fastening state may be more stably maintained using a double fixing scheme.

Second Embodiment

Figure 10:
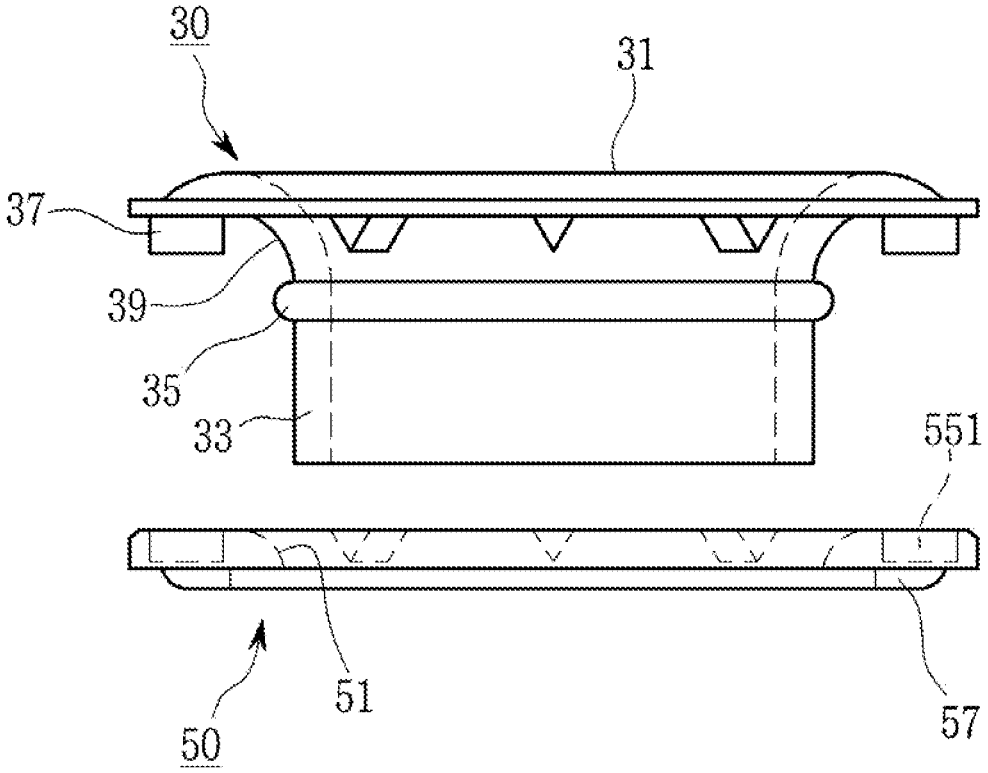
FIG. 10 is a front view illustrating an eyelet according to a second embodiment of the present disclosure.
Figure 11:
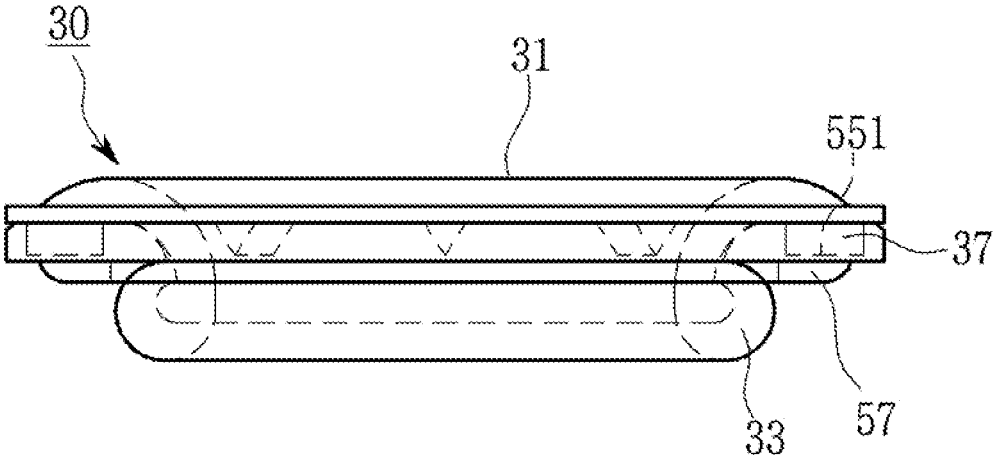
FIG. 11 is a view illustrating a state in which an eyelet base 30 and an eyelet washer 50 of FIG. 10 are coupled to each other.

FIG. 10 is a front view illustrating an eyelet according to a second embodiment of the present disclosure, and FIG. 11 is a view illustrating a state in which an eyelet base 30 and an eyelet washer 50 of FIG. 10 are coupled to each other.

Only a structure of the eyelet washer 50 in the eyelet according to the second embodiment of the present disclosure is different from that of the first embodiment, and other elements are the same as those of the first embodiment.

As shown in FIG. 10, the eyelet washer 50 according to the second embodiment includes a plurality of grooves 551 instead of the protrusions 55 in an upper surface of the eyelet washer 50 facing a base part 31, and the grooves 551 accommodate and fix the stoppers 37. The groove 551 is configured in a shape which is easy to accommodate and fix the stopper 37, and as shown in FIG. 10, may be formed in a shape corresponding to the stopper 37. Further, the grooves 551 are radially arranged at predetermined intervals in the upper surface of the eyelet washer 50 like the stopper 37.

In addition, as shown in FIG. 11, when the eyelet base 30 and the eyelet washer 50 are fastened to each other, since the stoppers 37 are accommodated in the grooves 551, the lower surface of the base part 31 and the upper surface of the eyelet washer 50 come into close contact with each other. Accordingly, an interval/a space between the base part 31 and the eyelet washer 50 may be minimized, and the entire thickness of the fastened eyelet may also be reduced.

An eyelet according to the present disclosure is coupled to a fabric using pressure not heat and thus damage to the fabric due to heat can be prevented.

Further, since separation of an eyelet washer from an eyelet base using a fixing protrusion is prevented, a coupling force between the fabric and the eyelet can be increased.

In addition, when the fabric is a tarpaulin, since the eyelet includes a material similar to the tarpaulin, the fabric and the eyelet can be recycled together.

As described above, although the present disclosure is described according to exemplary embodiments for exemplifying the principle of the present disclosure, the present disclosure is not limited to configurations and actions which are shown above. Preferably, those skilled in the art may understand that many changes and modifications according to the present disclosure are possible without departing from the spirit and the scope of the accompanying claims.

What is claimed is:

1. An eyelet comprising:

an eyelet base and an eyelet washer, wherein the eyelet base includes: a disk-shaped base part having a circular hollow hole formed at a center portion thereof; a cylindrical fastening part formed to extend from an inner circumference of the base part formed by the hollow hole to be orthogonal to the base part, and inserted into a circular hollow hole in a center portion of the eyelet washer to be fastened to the eyelet washer; a fixing protrusion formed in a ring shape on an outer circumference of the fastening part to prevent separation of the eyelet washer from the fastening part; and a plurality of stoppers configured to protrude from a lower surface of the base part to prevent rotation of the eyelet washer fastened to the eyelet base, the eyelet washer includes: a plurality of protrusions formed on an upper surface of the eyelet washer facing the base part and whose movement is limited by the stoppers to prevent the rotation of the eyelet washer; and a protection protrusion formed in a ring shape to protrude from a lower surface of the eyelet washer, and the protection protrusion is configured to fix and protect a lower end of the fastening part inserted between the fixing protrusion and the protection protrusion due to plastic deformation when the eyelet base and the eyelet washer are fastened to each other.

2. The eyelet of claim 1, wherein a diameter of the fixing protrusion is greater than a diameter of the circular hollow hole of the eyelet washer.

3. The eyelet of claim 1, wherein the fixing protrusion protrudes so as to have a step at the outer circumference of the fastening part.

4. The eyelet of claim 1, wherein an upper portion of the fixing protrusion includes a flat surface vertical to the outer circumference of the fastening part.

5. The eyelet of claim 4, wherein a lower portion of the fixing protrusion includes an inclined surface connected to the flat surface.

6. The eyelet of claim 1, wherein the eyelet base further includes a curved portion having a curvature at a portion in which the base part and the fastening part come into contact with each other.

7. The eyelet of claim 1, wherein the eyelet washer is fastened to the eyelet base between the base part and the fixing protrusion.

8. The eyelet of claim 1, wherein an inner circumference of the eyelet washer has an inclined surface so that an upper portion thereof has a diameter greater than a diameter of a lower portion thereof.

9. An eyelet comprising:

an eyelet base and an eyelet washer, wherein the eyelet base includes: a disk-shaped base part having a circular hollow hole formed at a center portion thereof; a cylindrical fastening part formed to extend from an inner circumference of the base part formed by the hollow hole to be orthogonal to the base part, and inserted into a circular hollow hole in a center portion of the eyelet washer to be fastened to the eyelet washer; a fixing protrusion formed in a ring shape on an outer circumference of the fastening part to prevent separation of the eyelet washer from the fastening part; and a plurality of stoppers configured to protrude from a lower surface of the base part to prevent rotation of the eyelet washer fastened to the eyelet base, the eyelet washer includes: a plurality of grooves formed in shapes corresponding to the stoppers in an upper portion of the eyelet washer facing the base part and configured to accommodate the stoppers in a one-to-one manner to prevent the rotation of the eyelet washer; and a protection protrusion formed in a ring shape to protrude from a lower surface of the eyelet washer, and the protection protrusion is configured to fix and protect a lower end of the fastening part inserted between the fixing protrusion and the protection protrusion due to plastic deformation when the eyelet base and the eyelet washer are fastened to each other.

* * * * *